US006886898B2

(12) United States Patent
Kojoh et al.

(10) Patent No.: US 6,886,898 B2
(45) Date of Patent: May 3, 2005

(54) DRIVING METHOD OF PIEZOELECTRIC ELEMENTS, INK-JET HEAD, AND INK-JET PRINTER

(75) Inventors: Yoshiaki Kojoh, Sakurai (JP); Hiroshi Ishii, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/305,019

(22) Filed: Nov. 27, 2002

(65) Prior Publication Data

US 2003/0122899 A1 Jul. 3, 2003

(30) Foreign Application Priority Data

Nov. 30, 2001 (JP) ..... 2001-366725

(51) Int. Cl.[7] ..... B41J 29/38
(52) U.S. Cl. ..... 347/10; 347/68
(58) Field of Search ..... 347/9, 10, 68–72; 239/4, 102.2; 310/311, 317

(56) References Cited

U.S. PATENT DOCUMENTS 4,879,568 A 11/1989 Bartky et al.
4,887,100 A 12/1989 Michaelis et al.
4,992,808 A 2/1991 Bartky et al.
5,003,679 A 4/1991 Bartky et al.
5,028,936 A 7/1991 Bartky et al.
6,149,258 A 11/2000 Kimura
6,155,500 A * 12/2000 Takase ..... 239/533.3
6,206,496 B1 * 3/2001 Ushioda ..... 347/10

FOREIGN PATENT DOCUMENTS

JP 6-297708 10/1994
JP 6-305134 11/1994
JP 10-114063 5/1998

* cited by examiner

*Primary Examiner*—Michael S. Brooke
(74) *Attorney, Agent, or Firm*—Birch, Stewart, Kolasch & Birch, LLP

(57) ABSTRACT

A rise time and/or a fall time of a driving voltage are set to be not less than 1/20 of a period of natural oscillation of an ink-jet head. This suppresses a driving voltage, an amount of generated heat, and dissipated power, which increase when there is a loss due to a resistor component of a charge/discharge system, such as wiring or switching elements, caused by a large current that is flown when the driving voltage rises or falls sharply. The rise time and/or fall time may be made not more than 1/3 of the period of natural oscillation. In this way, 80% or higher efficiency can be ensured for the oscillation energy of piezoelectric elements, which increases as the rise or fall of the driving voltage becomes sharper. Further, the rise time and/or fall time may be set in the vicinity of 1/20 of the period of natural oscillation. In this way, the ejection energy of the piezoelectric elements can be saturated almost completely. As a result, less driving voltage, less heat, and less power are required to drive piezoelectric elements, which are used in ink-jet recording apparatuses and other types of apparatuses.

16 Claims, 9 Drawing Sheets

DRIVING METHOD OF PIEZOELECTRIC ELEMENTS, INK-JET HEAD, AND INK-JET PRINTER

FIELD OF THE INVENTION

The present invention relates to a driving method of piezoelectric elements for driving piezoelectric elements of various devices, such as an ink-jet head of ink-jet printers, ultrasonic washing machines, ultrasound humidifiers, and ultrasonic motors, by applying a rectangular or trapezoidal wave thereto. The invention also relates to an ink-jet head that employs such a driving method, and an ink-jet printer that is provided with such an ink-jet head.

BACKGROUND OF THE INVENTION

An ink-jet head of ink-jet printers is provided with a less than half the natural period Tc of the ink pressure chambers. This intends to improve ejection efficiency in low-voltage driving.

Further, Japanese Publication for Unexamined Patent Application No. 6-305134 (published on Nov. 1, 1994) discloses a technique that relates to an ink-jet head and a driving method of the inkjet head. This technique teaches that T1, T2≧Tc, and T1, T2≧Ta, where Ta is the period of natural oscillation of piezoelectric elements, Tc is the period of natural oscillation of the ink in the ink pressure chambers, and T2 and T1 are the rise time and fall time, respectively, of the driving voltage of the piezoelectric elements. This is to stabilize the amount of ejected ink and to improve print quality.

The purposes of these prior art documents are all to stabilize the ejection rate. Further, the foregoing publications assume low driving frequencies (on the order of several kilo pulses per second to several tens of kilo pulses per second). These techniques can be applied to a driving mode that uses high driving frequencies (hundreds of kilo pulses per second), such as multi-drop driving, when their rise time T1 and fall time T2 are made shorter. However, a rise time or a fall time that is too short causes the generated heat to accumulate and this increases the head temperature, with the result that ejection characteristics may fluctuate or ejection failure may occur. Another problem is that it increases dissipated power.

On the other hand, when the rise time T2 and fall time T1 are made too long in an effort to lower driving frequencies of the piezoelectric elements, it then becomes necessary to increase the driving voltage and thereby requires a high-voltage power supply to ensure a sufficient amount of ink to be ejected.

SUMMARY OF THE INVENTION

The present invention was made to solve the foregoing problems and accordingly it is an object of the present invention to provide a driving method of piezoelectric elements, by which a driving voltage, generated heat, and power dissipation can be reduced.

A driving method of piezoelectric elements according to the present invention (present driving method) is a method in which at least one of Tr and Tf is set to be not less than 1/20 of Ti, where Tr and Tf are the rise time and fall time, respectively, of a driving voltage that is applied to the piezoelectric elements, and Ti is the period of natural oscillation of a system (oscillating system) that is oscillated by the piezoelectric elements.

The present driving method drives piezoelectric elements (piezoid) of various devices or apparatuses, such as ink-jet heads, ultrasonic washing machines, ultrasonic humidifiers, and ultrasonic motors, by applying a rectangular or trapezoidal wave thereto.

The piezoelectric elements have a structure analogous to that of a capacitor, with a dielectric placed between a pair of electrodes. In the present driving method, at least one of Tr and Tf of the driving voltage applied to the piezoelectric elements is set to be not less than 1/20 of Ti, which is the period of natural oscillation of the oscillating system that is oscillated by the piezoelectric elements.

In this way, the present driving method can eliminate a loss due to a resistor component of a charge/discharge system, such as wiring or switching elements, caused by a large current that is flown when Tr and/or Tf are too small. As a result, heat generation as well as power dissipation can be suppressed.

For a fuller understanding of the nature and advantages of the invention, reference should be made to the ensuing detailed description taken in conjunction with the accompanying drawings.

DESCRIPTION OF THE EMBODIMENTS

One embodiment of the present invention is described below.

A printer according to the present embodiment ("present printer" hereinafter) has a function of receiving image data from an external information processing device such as a computer or a digital camera, and processing the image data, so as to print its image on a printing sheet such as paper or plastic for output.

Figure 1:
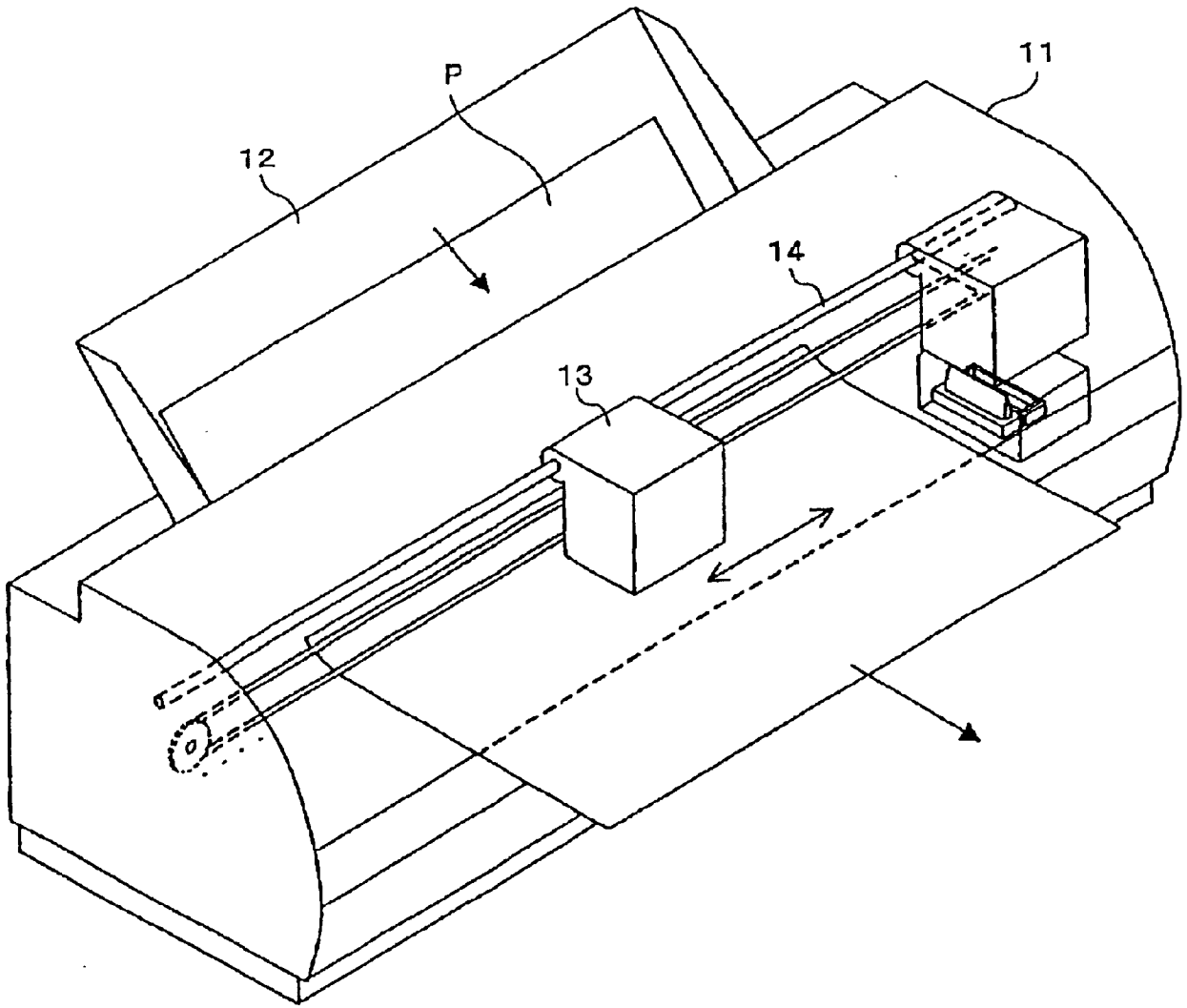
FIG. 1 is a perspective view showing a configuration of an ink-jet printer according to one embodiment of the present invention.

FIG. 1 is a perspective view showing a configuration of the present printer. As shown in FIG. 1, the present printer includes a sheet guide 12, an ink-jet head 13, a holding shaft 14, and transport rollers (not shown), which are all provided within a casing 11 along with other components.

The present printer further includes a control section (not shown), which receives image data that was transmitted from an information processing device such as a computer (not shown) and controls the foregoing printer components to carry out a print job.

The sheet guide 12 serves as a feeder tray and/or a feeder guide that support a sheet P before and during a print job.

The ink-jet head 13, under the control of the control section, ejects ink (printing agent) onto a sheet that is being transported with the transport rollers, so as to print an image on the sheet.

The ink-jet head 13 is adapted to move back and forth within a scanning space that is provided within the present printer, so as to print the image line by line on the sheet.

The holding shaft 14, provided within the scanning space, is a guide that serves to guide the ink-jet head 13 in a scanning direction.

Figure 2:
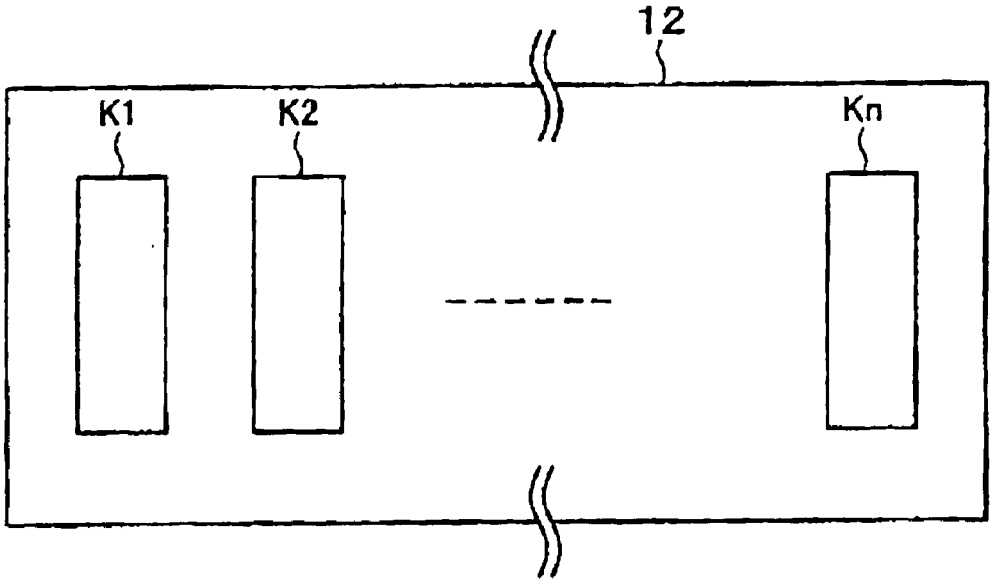
FIG. 2 is an explanatory drawing showing a configuration of an ink-jet head in the ink-jet printer of FIG. 1.

FIG. 2 is an explanatory drawing showing a structure of the ink-jet head 13. As FIG. 2 illustrates, the ink-jet head 13 has a multiplicity of ink pressure chambers K1 through Kn.

The ink pressure chambers K1 through Kn each contain ink and a nozzle for ejecting the ink. In addition, a driving circuit that controls ejection of the ink is provided for each of the ink pressure chambers K1 through Kn. Portions of partition walls of the ink pressure chambers K1 through Kn make up piezoelectric elements.

The ink pressure chambers K1 through Kn of the ink-jet head 13 expand and contract in response to a driving voltage that is applied to their piezoelectric elements. By this action, the ink-jet head 13 ejects ink though the nozzles, so as to form an image on the sheet (recording sheet).

Note that, no further explanation for such a driving method is given here because it is described in detail, for example, in Japanese Publication for Examined Patent Application No. 6-61936 (Japanese Patent; published on Aug. 17, 1994).

Figure 3:
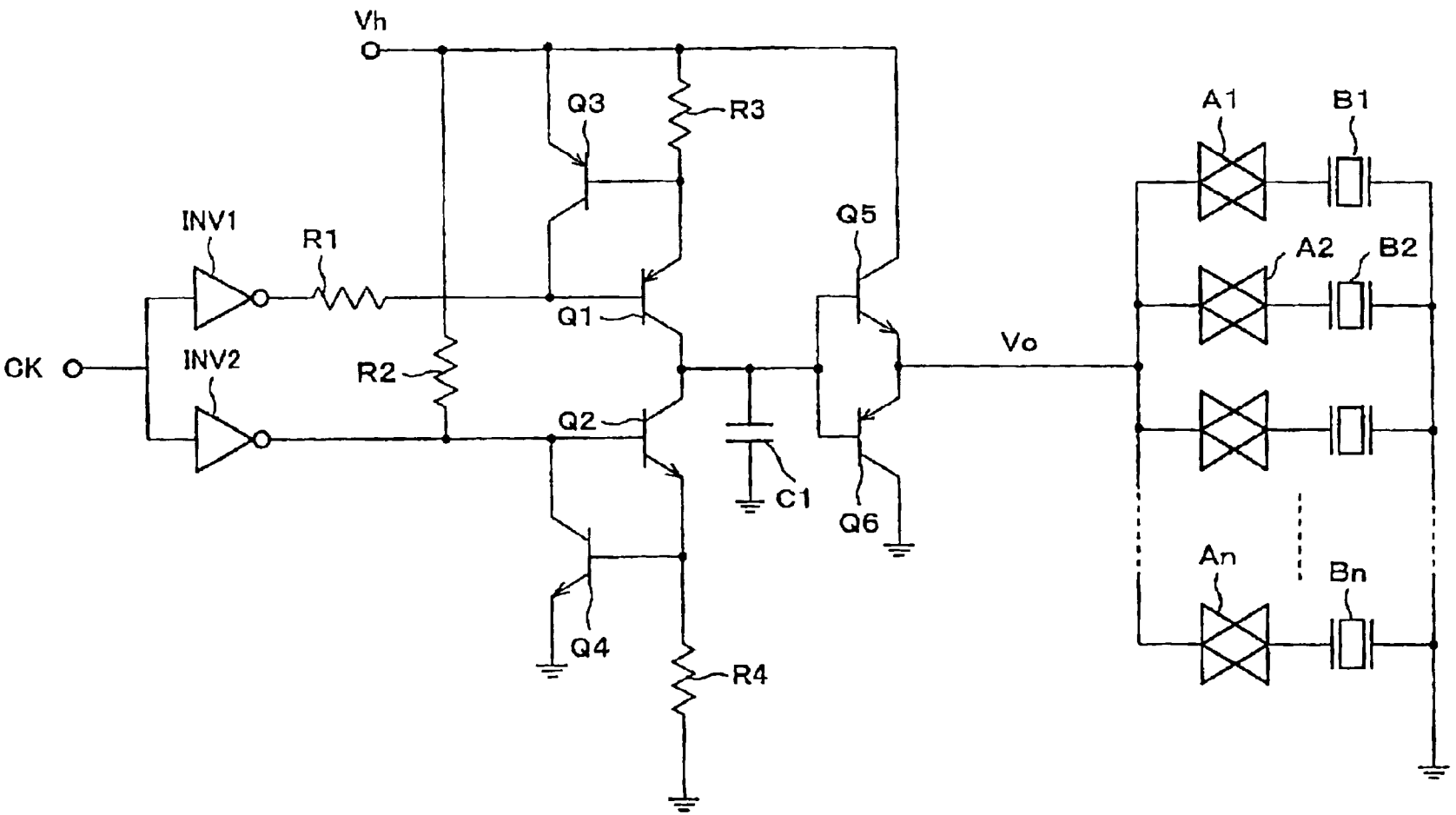
FIG. 3 is an electrical circuit diagram of a driving circuit of the ink-jet head in the ink-jet printer according to one embodiment of the present invention.

FIG. 3 is an electrical circuit diagram of a driving circuit 21 of the ink pressure chambers K1 through Kn.

As shown in FIG. 3, in the driving circuit 21, a driving signal CK is supplied to a base of a PNP-type transistor Q1 via an open-collector-type inverter INV1 and a resistor R1. The driving signal CK is also supplied to a base of an NPN-type transistor Q2 via an inverter INV2.

An emitter of the transistor Q1 is connected to a power supply of a high level Vh via an emitter resistor R3.

Between the base of the transistor Q1 and the power supply of the high level Vh is disposed a PNP-type transistor Q3. A base of the transistor Q3 is connected to the emitter of the transistor Q1.

An emitter of the transistor Q2 is connected to a power supply of a low level GND via an emitter resistor R4.

Between the base of the transistor Q2 and the power supply of the low level GND is disposed an NPN-type transistor Q4. A base of the transistor Q4 is connected to the emitter of the transistor Q2.

The base of the transistor Q2 is connected to the power supply of the high level Vh via a pull-up resistor R2.

To the collectors of the transistors Q1 and Q2 is connected one terminal of a capacitor C1. The other terminal of the capacitor C1 is connected to the power supply of the low level GND. An output voltage from one of the terminals of the capacitor C1 is commonly supplied to bases of transistors Q5 and Q6.

A collector of the NPN-type transistor Q5 is connected to the power supply of the high level Vh. A collector of the PNP-type transistor Q6 is connected to the power supply of the low level GND. An output voltage Vo is drawn from emitters of the transistors Q5 and Q6. The output voltage Vo is selectively supplied to piezoelectric elements B1 through Bn by analog switches A1 through An that are driven according to the image data.

Figure 4:
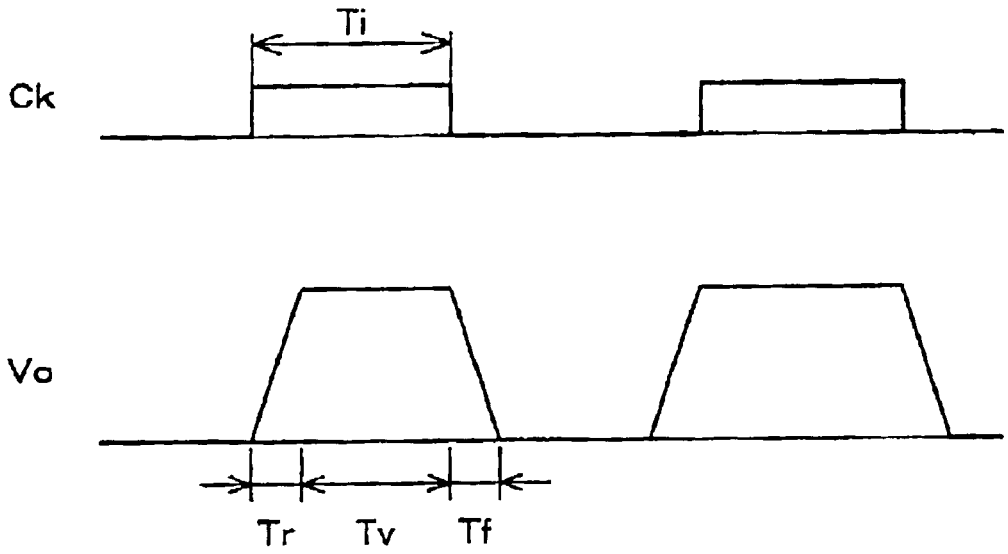
FIG. 4 is a waveform diagram explaining operations of the driving circuit of FIG. 3.

Thus, as shown in FIG. 4, when the driving signal CK is at high level, the output level of the inverter INV1 becomes low to charge the capacitor C1 through the transistor Q1. Here, the transistor Q2 is OFF. The emitter current of the transistor Q1 is held constant by the resistor R3 and the transistor Q3. The output voltage Vo of the transistor Q5, which varies according to the output voltage of the capacitor C1, rises as shown in FIG. 4.

On the other hand, when the driving signal CK is at low level, the output level of the inverter INV2 becomes high to discharge the capacitor C1 through the transistor Q2. Here, the transistor Q1 is OFF. The emitter current of the transistor Q2 is held constant by the resistor R4 and the transistor Q3. The output voltage Vo of the transistor Q6, which varies according to the output voltage of the capacitor C1, falls as shown in FIG. 4.

The driving circuit 21 operates to set a suitable value for a slew rate α of a rise time Tr and a fall time Tf of the output voltage Vo, so as to suppress a driving voltage, an amount of generated heat, and power dissipation.

The slew rate a is a rate at which a rectangular or trapezoidal pulse of the driving voltage that drives the piezoelectric elements B1 through Bn changes its value from a 10% peak value Vp ($V_{10}$) to a 90% peak value VP ($V_{90}$) (unit: V/sec). Hence, the slew rate a is given by $$\alpha=(V_{90}-V_{10})/Tr=\Delta V/Tr \quad (1)$$

where Tr is the time required for the pulse to rise from level $V_{10}$ to level $V_{90}$. The slew rate α of a fall time can be obtained in a similar fashion by replacing Tr with Tf (time required for the pulse to fall from level $V_{90}$ to level $V_{10}$). The driving circuit 21 shown in FIG. 3 can set any value for the slew rate α by adjusting resistance values of the resistors R3 and R4.

The following explains suitable values of the slew rate α in detail. Specifically, the slew rate α preferably has a value that satisfies $$\alpha \leqq 20\times\Delta V/Ti(V/\text{sec})$$

where ΔV is the value of a pulse voltage of the output voltage Vo supplied to the piezoelectric elements B1 through Bn, and Ti is the period of natural oscillation of an oscillating system of the ink pressure chambers K1 through Kn (objects oscillated by the piezoelectric elements B1 through Bn in the ink pressure chambers K1 through Kn; ink ejecting system).

More preferably, the slew rate α should have a value that satisfies $$\alpha \leqq 10\times\Delta V/Ti(V/\text{sec}).$$

Further, since α=ΔV/Tr=ΔV/Tf, it is preferable that the rise time Tr and fall time Tf of the pulse voltage (output voltage) satisfy $$1/20 \leqq Tr/Ti, \text{ and } 1/20 \leqq Tf/Ti \quad (a),$$

or more preferably $$1/10 \leqq Tr/Ti, \text{ and } 1/10 \leqq Tf/Ti \quad (b).$$

In addition to these conditions, Tr and Tf should satisfy $$Tr/Ti \leqq 1/3, \text{ and } Tf/Ti \leqq 1/3 \quad (c).$$

The foregoing ranges of α, Tr/Ti, and Tf/Ti are preferable for the reasons described below. (It is assumed here that Tr=Tf.)

The piezoelectric element generally has a structure analogous to that of a capacitor, with a dielectric placed between a pair of electrodes. The charge Q injected into the piezoelectric element during driving can be given by $$Q=CV \quad (2)$$

$$\text{Since } Q=\int i dt \quad (3),$$

$$C\cdot(V/Tr)=C\cdot(V/Tf)=i \quad (4).$$

It can be seen from this that a current i increases when the rise or fall of the driving voltage V is sharp. For example, increasing the slew rate a by two fold (Tr and Tf are reduced in half) doubles the magnitude of current i.

Meanwhile, an amount of generated heat U is given by $$U=i^2\cdot R(Tr+Tf) \quad (5).$$

where R is a resistor component of a charge/discharge system, such as wiring or analog switches in the head.

It can be seen from this that increasing the slew rate $\alpha$ decreases Tr and Tf. This, with the current i squared, increases the amount of generated heat and power dissipation.

The ability to eject ink is dependent on the kinetic energy (velocity Vmax) of the oscillating system in the ink pressure chambers. That is, a more gradual slew rate $\alpha$ (slope) must be compensated for with an increased driving voltage, which corresponds to displacement, in order to eject the ink at the same pressure. The reason for this is explained below.

Figure 5:
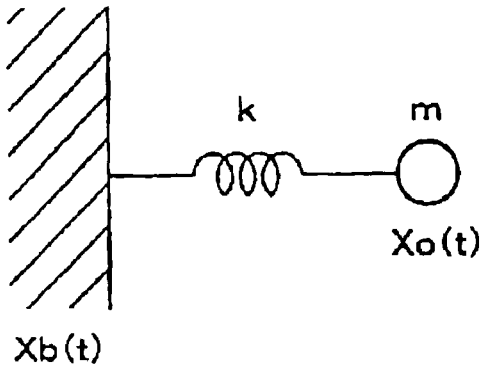
FIG. 5 is a drawing of an oscillation model, explaining an oscillating system of the ink-jet head.
Figure 6:
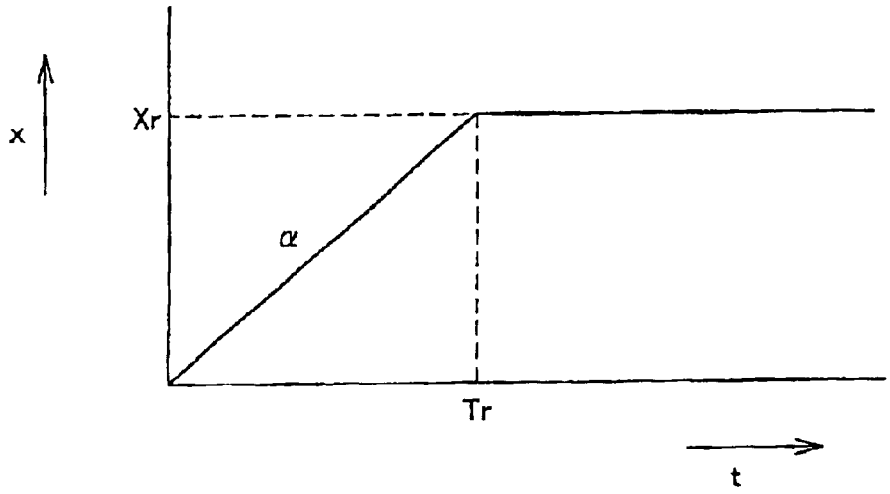
FIG. 6 is a graph explaining a slew rate (slope) of a driving pulse of the ink-jet head.

The oscillating system in the ink pressure chambers (ink ejecting system) can be thought as an oscillating system shown in FIG. 5. The slew rate $\alpha$ is set such that a desired displacement Xr is obtained at a given time Tr, as shown in FIG. 6. The motion of the oscillating system of time t<Tr can be expressed by the following function that equates velocity with position.

$$m\{d^2xo(t)/dt^2\}+k\{xo(t)-xb(t)\}=0 \quad (6)$$

where m is the equivalent mass of the oscillating system of the ink pressure chambers, xo(t) is the position at time t, xb(t) is the position at origin, and k is the equivalent elasticity.

Solving this equation by transforming time t into a function s using a Laplace transformation gives $$m\cdot s^2\cdot Xo(s)+k\{Xo(s)-Xb(s)\}=0 \quad (7).$$

Combining Equation (7) with a Laplace integral of a linear function xb(t)=$\alpha\cdot t$ gives $$(s^2+k/m)Xo(s)=Xb(s)k/m=\alpha\cdot k/(m\cdot s^2) \quad (8).$$

Figure 7:
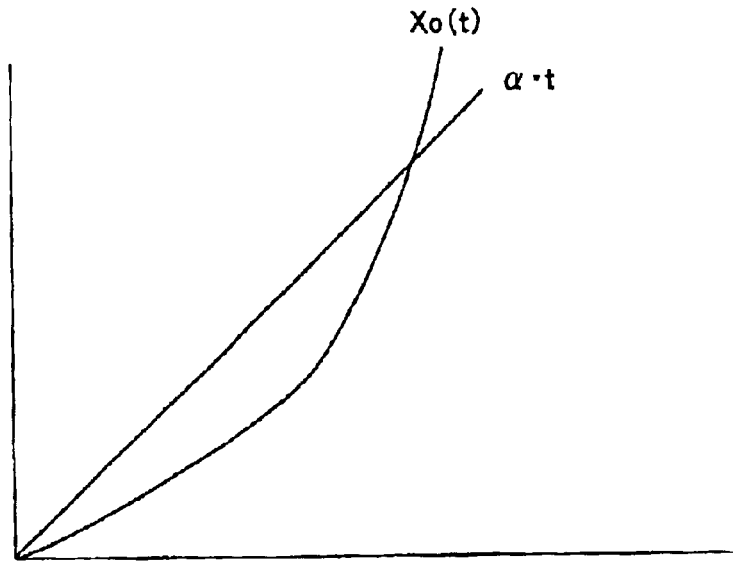
FIG. 7 is a graph explaining a relation between the slew rate and a displaced amount (deformed amount) of piezoelectric elements.

Rearranging Equation (8) for Xo(s) gives $$Xo(s)=\alpha\cdot k/\{m\cdot s^2(s^2+\omega n^2) \quad (9)$$

where $\omega n^2$=k/m. By an inverse Laplace transformation of Equation (9), Xo(t) is given as follows, as shown in FIG. 7.

$$\begin{aligned} Xo(t) &= (\alpha\cdot k/m)(1/\omega n^3)(\omega n\cdot t-\sin(\omega n\cdot t)) \quad (10)\\ &= (\alpha/\omega n)(\omega n\cdot t-\sin(\omega n\cdot t))\\ &= \alpha\{t-(1/\omega n)\cdot\sin(\omega n\cdot t)\}. \end{aligned}$$

According to an estimation theorem and when time t≧Tr, a Laplace transformation of a kinked line xb'(t) that is created by a rise portion, ending at the rise time Tr, and an upper base portion of the trapezoid gives $$Xb'(s)=\omega n(\alpha/s^2)(1-\epsilon^{-Tr\cdot s}) \quad (11).$$

Substituting Equation (11) into Equation (8) gives $$Xo'(s)=\omega n(\alpha/s^2)(1-\epsilon^{-Tr\cdot s})/(s^2+\omega n^2) \quad (12).$$

An inverse Laplace transformation of Equation (12) gives a displacement xo'(t) with respect to the kinked line xb'(t), which is given by $$\begin{aligned} xo'(t) &= xo(t)-xo(t-Tr) \quad (13)\\ &= \alpha(t-(1/\omega n)\cdot\sin(\omega n\cdot t))-\\ &\quad \alpha\{(t-Tr)-(1/\omega n)\cdot\sin(\omega n\cdot(t-Tr))\}, \end{aligned}$$

where time t≧Tr.

Rearranging Equation (13) gives $$xo'(t)=Xr(1-(2/(\omega n\cdot Tr))\cdot\sin(\omega n\cdot(Tr/2))\cdot\cos(\omega n\cdot(2t-Tr)/2)) \quad (14).$$

Figure 8:
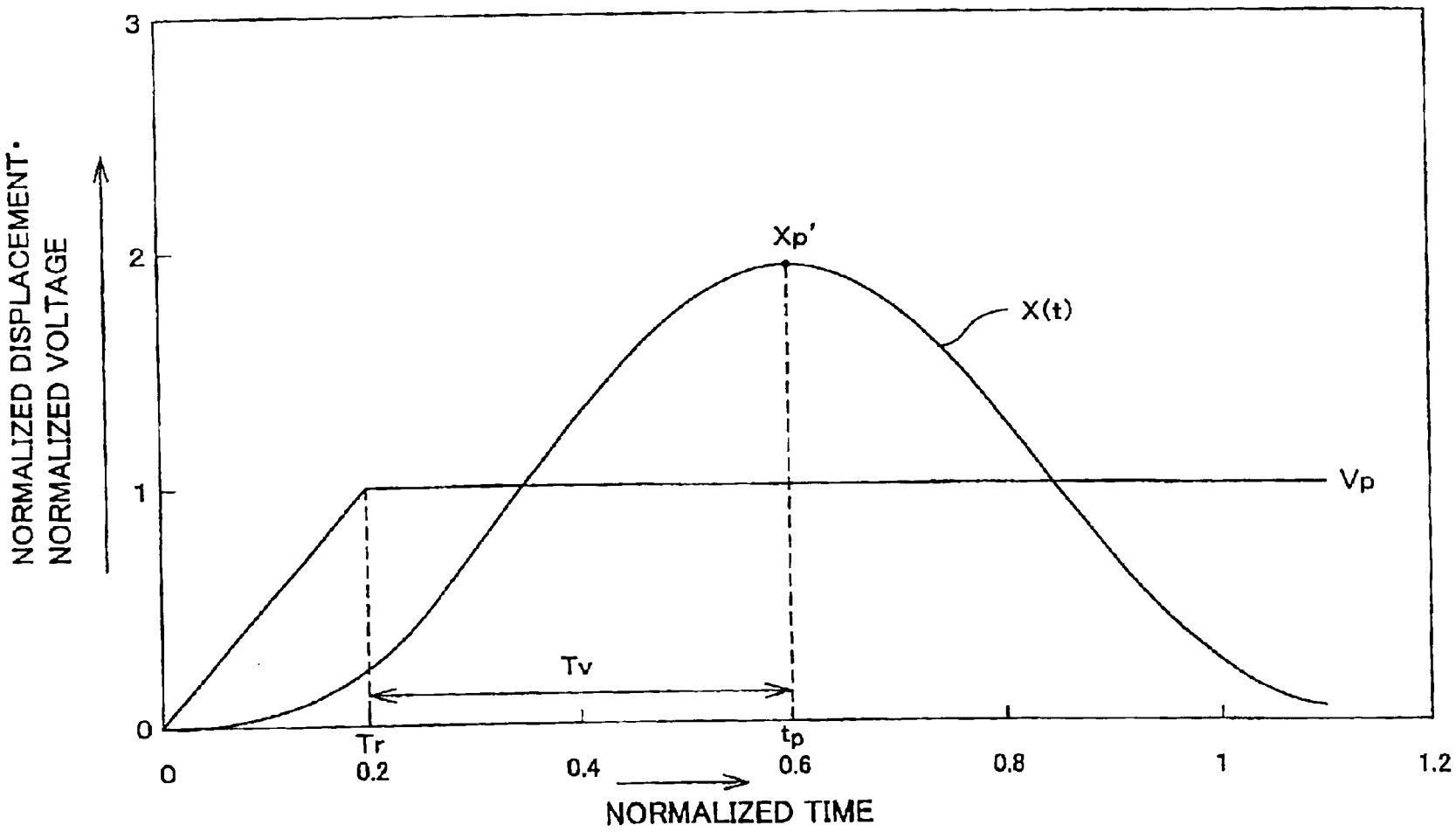
FIG. 8 is a graph explaining conditions for obtaining a maximum displacement (deformation) of the piezoelectric elements.

Solving Equations (10) and (14) for displacement X(t) with normalized Xr=1 and Tr=0.2 gives a graph shown in FIG. 8.

From Equation (14) and FIG. 8, a condition tp that gives a maximum displacement Xp' with respect to the input kinked line is $$tp=(Ti+Tr)/2 \quad (15).$$

A sustained time TV, corresponding to an upper base portion of the trapezoidal waveform, which gives the maximum displacement Xp' is $$Tv=(Ti-Tr)/2 \quad (16).$$

Note that, Xp' is a maximum displacement when time t≧Tr.

It can be seen from this that the maximum displacement Xp' of the oscillating system decreases (maximum velocity decreases) and the required driving voltage increases when the rise or fall of the driving voltage of the piezoelectric elements becomes gradual (longer Tr or Tf in the foregoing equation) with its driving pulse fixed to maintain a predetermined recurring ejection frequency. As a result, a high-voltage power supply will be required.

Figure 9:
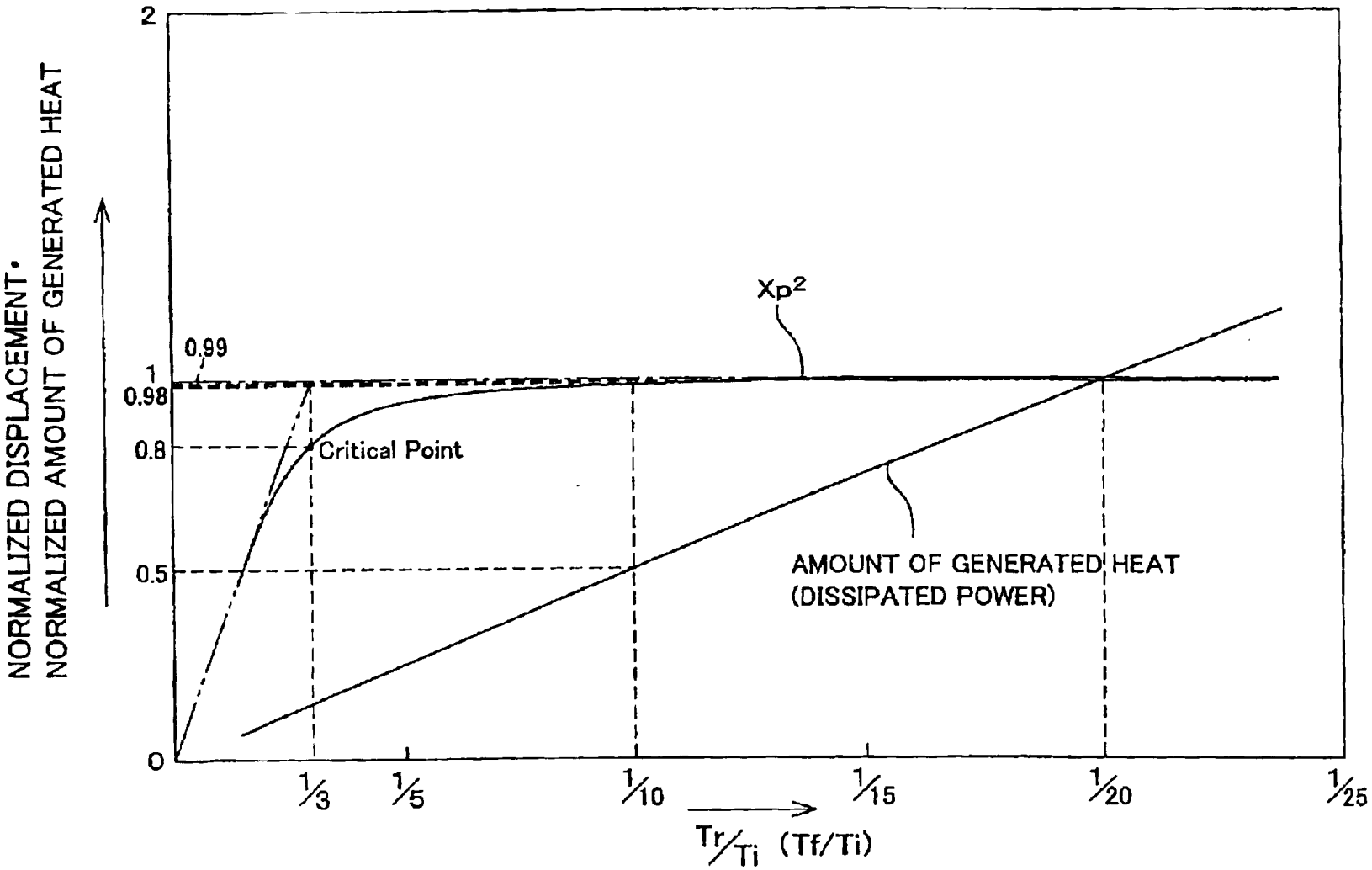
FIG. 9 is a graph explaining how an amount of displacement and an amount of generated heat (dissipated power) vary with respect to changes in rise time Tr and fall time Tf of the driving pulse for the piezoelectric elements.

FIG. 9 shows a state of oscillation and a state of heat generation when a pulse of an arbitrary slew rate is applied to the oscillating system in the ink pressure chambers K1 through Kn (and piezoelectric elements B1 through Bn).

The oscillation energy (energy to eject ink) given to the oscillating system all becomes the energy of displacement at the maximum displacement where the oscillation velocity= Q. Thus, the oscillation energy, given a sufficient pulse width (the maximum displacement occurs when the cosine term is −1 or +1, and when the product of the sine term and the cosine term is negative in Equation (14)), is determined as a function of a maximum displacement Xp squared. Note that, Xp is a maximum displacement when time t<Tr.

Accordingly, FIG. 9 shows $Xp^2$, which has been normalized by with the value of 1 for the saturation value of the oscillation energy. In other words, FIG. 9 indicates the efficiency of oscillation energy at different values of Tr/Ti, with respect to the saturated oscillation energy when Tr/Ti is sufficiently small. FIG. 9 also shows the amount of heat generated by the driving according to Equation (5), by normalizing it using the value (of 1) at Tr/Ti=1/20 as a reference. As FIG. 9 indicates, the amount of generated heat tends to increase linearly with decrease in Tr/Ti.

From FIG. 9, it is possible to find a ratio Tr/Ti that more efficiently gives oscillation energy while suppressing heat generation of the driving circuit. Namely, at Tr/Ti=1/20, $Xp^2$ is=0.99 (efficiency: 99%; the efficiency being a ratio with respect to the oscillation energy when Tr/Ti is sufficiently small), and the normalized amount of generated heat is 1. Further decreasing the ratio Tr/Ti hardly increases efficiency and only the amount of generated heat is increased. At Tr/Ti=1/10, $Xp^2$ is=0.98 (efficiency: 98%) and the amount of generated heat is 0.5, which is half the amount of generated heat at Tr/Ti=1/20, even though the efficiency is down by about 1%. When Tr/Ti is increased extremely to further reduce the amount of generated heat, $Xp^2$ decreases abruptly. In this case, the driving voltage needs to be increased to obtain the same oscillation energy. Here, $Xp^2$= 0.80 (efficiency: 80%), at which $Xp^2$ shows an abrupt decrease, is defined as a critical point. For stable driving, $Xp^2$ should not be smaller than the critical value. In order to secure a range at or above this critical point, it is required that Tr/Ti be not more than 1/3.

That is, in order to obtain oscillation energy more efficiently while suppressing heat generation of the driving circuit, Tr/Ti needs to satisfy $$1/20 \leqq Tr/Ti \leqq 1/3,$$

and in order to take measure against heat generation, Tr/Ti should preferably satisfy $$1/10 \leqq Tr/Ti \leqq 1/3.$$

The following describes the case where the ink-jet head 13 of the present printer is adapted to eject ink by causing the ink pressure chambers K1 through Kn to expand and contract. Note that, in this case, the time required for the ink pressure chambers K1 through Kn to expend and maintain the expansion is set to half the period Ti' of natural oscillation of the oscillating system in the ink pressure chambers K1 through Kn.

Figure 10:
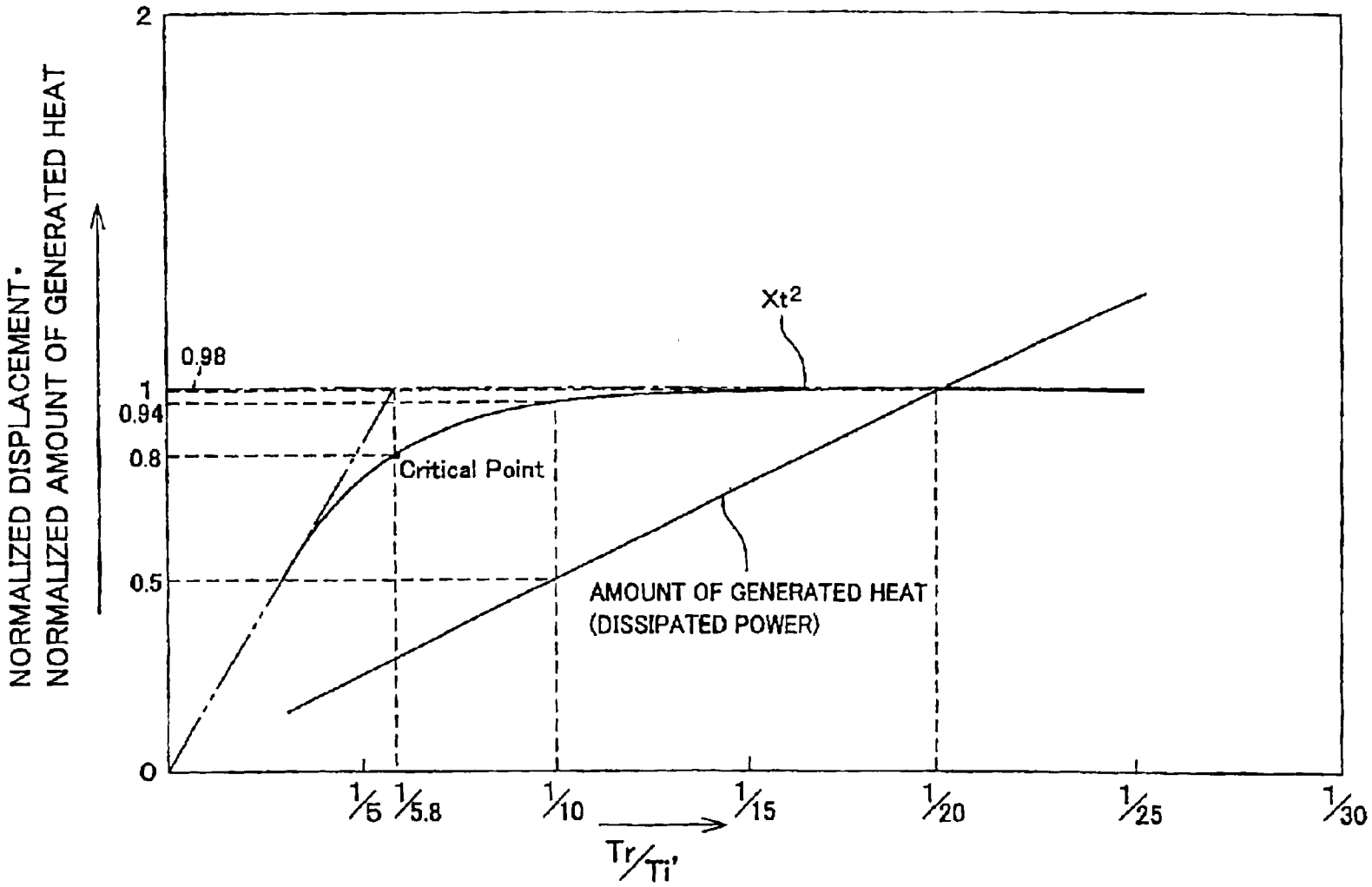
FIG. 10 a graph explaining how an amount of displacement and an amount of generated heat (dissipated power) vary with respect to changes in rise time Tr and fall time Tf of the driving pulse for the piezoelectric elements, pertaining to a driving method in which ink pressure chambers are caused to expand and contract to eject ink.

In expansion/contraction driving, the displacement Xt at the end of the expansion stroke becomes the initial displacement of contraction. Thus, the oscillation energy of ejecting the ink by contraction can be increased by increasing the final displacement Xt of contraction as high as possible. FIG. 10 shows a state of oscillation and a state of heat generation at the end of expansion, i.e., at time t=Ti/2, as with FIG. 9.

Figure 11:
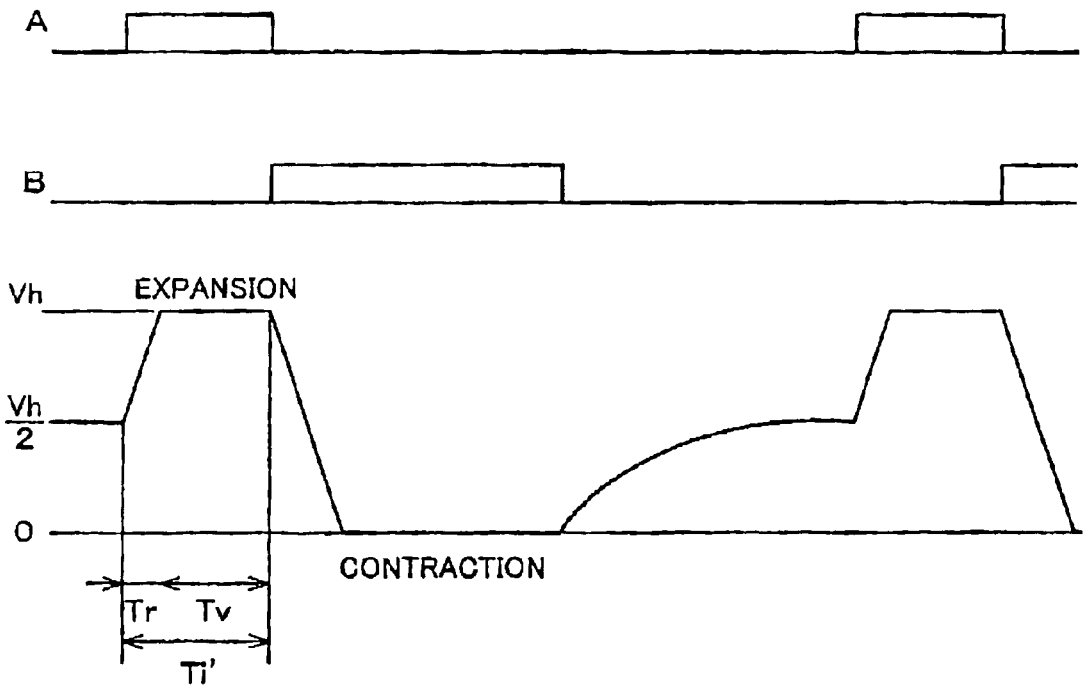
FIG. 11 is a waveform diagram explaining the driving method.

The piezoelectric elements B1 through Bn attached to the ink pressure chambers K1 through Kn expand with the driving waveform of phase A and contract with the driving waveform of phase B, as shown in FIG. 11. That is, the piezoelectric elements B1 through Bn receive a voltage Vh/2 in the state of non-driving, Vh when expanding, and 0 V when contracting, with respect to the voltage of contraction.

From FIG. 10, it is possible to find a ratio Tr/Ti that more efficiently gives the oscillation energy while suppressing heat generation of the driving circuit. Namely, at Tr/Ti=1/20, $Xp^2$ is=0.98 (efficiency: 98%) and the normalized amount of generated heat is 1. Further decreasing the ratio Tr/Ti hardly increases efficiency and only the amount of generated heat is increased. At Tr/Ti=1/10, $Xp^2$ is=0.94 (efficiency: 94%) and the amount of generated heat is 0.5, which is half the amount of generated heat at Tr/Ti=1/20, even though the efficiency is down by about 4%. When Tr/Ti is increased extremely to further reduce the amount of generated heat, $Xp^2$ decreases abruptly. In this case, the driving voltage needs to be increased to obtain the same oscillation energy. Here, $Xp^2$= 0.80 (efficiency: 80%), at which $Xp^2$ shows an abrupt decrease, is defined as a critical point. For stable driving, $Xp^2$ should not be smaller than the critical value. In order to secure a range at or above this critical point, it is required that Tr/Ti be not more than about 1/6. (To be more exact, 1/5.8 in FIG. 10.)

That is, in order to obtain oscillation energy more efficiently while suppressing heat generation of the driving circuit, Tr/Ti needs to satisfy $$1/20 \leqq Tr/Ti \leqq 1/6,$$

and in order to take measure against heat generation, Tr/Ti should preferably satisfy $$1/10 \leqq Tr/Ti \leqq 1/6.$$

Further, maximum efficiency can be achieved by setting the sustained time Tv, which is the time period after the rise of the pulse voltage, to (Ti'−Tr)/2, as indicated in Equation (16).

The present embodiment assumes that the rise time Tr is equal to the fall time Tf (Tr=Tf). However, not limiting to this, Tr and Tf may have different values when they satisfy the foregoing inequalities (a) (or (b)) and (c).

It is not necessarily required that Tr and Tf satisfy both (a) (or (b)) and (c). By setting Tr and Tf to satisfy any of these inequalities (a), (b), and (c), it is possible to suppress an amount of generated heat or a driving voltage, in addition to ensuring sufficient displacement of the piezoelectric elements.

It is also not necessarily required that Tr and Tf both satisfy (a) (or (b)) and/or (c). By setting one of Tr and Tf to satisfy (a) (or (b)) and/or (c), it is possible to suppress, to a limited degree, an amount of generated heat or a driving voltage, in addition to ensuring sufficient displacement of the piezoelectric elements.

The ink-jet printer described so far is one example of an ink-jet recording apparatus.

The present embodiment described the case where the driving method of piezoelectric elements of the present invention is applied to the ink-jet printer with the ink-jet head 13. However, not just limiting to the piezoelectric elements of the ink-jet head, the driving method of the present invention can be suitably used to drive piezoelectric elements (piezoid) in ultrasonic washing machines, ultrasonic humidifiers, ultrasonic motors, and the like, by applying a rectangular or trapezoidal wave thereto.

In one configuration of the driving circuit (21) of the piezoelectric elements of the present invention, at least one of Tr and Tf is set to be not less than 1/20 of Ti, where Ti is the period of natural oscillation of the oscillating system that is oscillated by the piezoelectric elements B1 through Bn, and Tr and Tf are the rise time and fall time, respectively, of the driving voltage applied to the piezoelectric elements B1 through Bn.

As described, in the driving method of piezoelectric elements according to the present invention (present driving method), at least one of Tr and Tf is set to be not less than 1/20 of Ti, where Ti is the period of natural oscillation of the oscillating system that is oscillated by the piezoelectric elements, and Tr and Tf are the rise time and fall time, respectively, of the driving voltage applied to the piezoelectric elements.

The present driving method drives piezoelectric elements (piezoid) that are used in ultrasonic washing machines, ultrasonic humidifiers, ultrasonic motors, and the like, by applying a rectangular or trapezoidal wave thereto.

The piezoelectric elements have a structure analogous to that of a capacitor, with a dielectric placed between a pair of electrodes. The present driving method adjusts at least one of Tr and Tf of the driving voltage that is applied to the piezoelectric elements, so that Tr and/or Ti is not less than 1/20 of the period Ti of natural oscillation of the oscillating system that is oscillated by the piezoelectric elements.

In this way, the present driving method can eliminate a loss due to a resistor component of a charge/discharge system, such as wiring or switching elements, caused by a large current that is flown when Tr and/or Tf are too small. As a result, heat generation as well as power dissipation can be suppressed.

It is also preferable in the present driving method that at least one of Tr and Tf is set to be not less than 1/10 of Ti. In this way, the amount of generated heat can be halved without losing the efficiency of oscillation energy by a large margin (down by 1%). Here, the efficiency of oscillation energy is a ratio with respect to a saturated oscillation energy when Tr/Ti is sufficiently small. This is advantageous because it eases designing of the driving circuit against heat dissipation and thereby reduces cost.

It is also preferable in the present driving method that at least one of Tr and Tf is set to be not more than 1/3 of Ti. In this way, an abrupt decrease of oscillation energy can be prevented (80% or higher efficiency can be ensured). As a result, an increase of the driving voltage can be suppressed. Here, the efficiency of oscillation energy is a ratio with respect to a saturated oscillation energy when Tr/Ti is sufficiently small. This is advantageous because it eases power designing of the driving circuit and thereby reduces cost.

It is also preferable in the present driving method that at least one of Tr and Tf is not more than 1/6 of Ti. In this way, an abrupt decrease of oscillation energy can be prevented (80% or higher efficiency can be ensured) in driving that involves bi-directional deformation, in which the oscillating system is adapted to expand and contract. As a result, an increase of the driving voltage can be suppressed. Here, the efficiency of oscillation energy is a ratio with respect to a saturated oscillation energy when Tr/Ti is sufficiently small. This is advantageous because it eases power designing of the driving circuit and thereby reduces cost.

It is preferable in the driving method of the present invention that the sustained time Tv of the driving voltage satisfies $Tv \approx (Ti-Tr)/2$.

A displacement of the piezoelectric elements with respect to the driving voltage becomes maximum at $(Ti+Tr)/2$. Therefore, a displacement of the piezoelectric elements can reach its maximum value when the driving voltage is sustained over the time period of sustained time Tv, which, in a preferred embodiment, is the time period $(Ti+Tr)/2$ after the rise of the driving voltage.

Thus, maximum efficiency can be achieved by so setting the sustained time Tv of the driving voltage and by switching polarities of the driving voltage after the sustained time Tv.

The ink-jet head of the present invention (present head) includes a multiplicity of ink pressure chambers with partition walls, portions of the partition walls making up piezoelectric elements, the ink-jet head applying a driving voltage to the piezoelectric elements to cause the piezoelectric elements to deform, so as to eject ink that is stored in the ink pressure chambers, the ink-jet head setting at least one of Tr and Tf to be not less than 1/20 of Ti, where Tr and Tf are a rise time and a fall time, respectively, of the driving voltage that is applied to the piezoelectric elements, and Ti is a period of natural oscillation of an oscillating system in the ink pressure chambers.

That is, the present head is an ink-jet head that employs the foregoing present driving method. In this way, the present head can eliminate a loss due to a resistor component of a charge/discharge system, such as wiring or switching elements, caused by a large current that is flown when Tr and/or Tf are too small. As a result, heat generation as well as power dissipation can be suppressed.

The ink-jet printer of the present invention (present printer) includes an ink-jet head that includes a multiplicity of ink pressure chambers with partition walls, portions of the partition walls making up piezoelectric elements, the ink-jet head applying a driving voltage to the piezoelectric elements to cause the piezoelectric elements to deform, so as to eject ink that is stored in the ink pressure chambers, the ink-jet printer setting at least one of Tr and Tf to be not less than 1/20 of Ti, where Tr and Tf are a rise time and a fall time, respectively, of the driving voltage that is applied to the piezoelectric elements, and Ti is a period of natural oscillation of an oscillating system in the ink pressure chambers.

That is, the present printer is a printer that is provided with the foregoing present head. In this way, the present printer can eliminate a loss due to a resistor component of a charge/discharge system, such as wiring or switching elements, caused by a large current that is flown when Tr and/or Tf are too small. As a result, heat generation as well as power dissipation can be suppressed.

In one aspect of the present invention, there is provided a driving method of piezoelectric elements, which can be suitably used to drive piezoelectric elements of an ink-jet head of ink-jet recording apparatuses, ultrasonic washing machines, ultrasonic humidifiers, ultrasonic motors, and the like, by applying a rectangular or trapezoidal wave thereto. The present invention also provides an ink-jet recording apparatus that employs such a driving method.

The foregoing Tokukaihei 6-305134 teaches setting $T1+T2 \geqq Tc/2$, where Tc is the period of natural oscillation in the ink pressure chambers, and T2 and T1 are the rise time and fall time of the driving voltage, respectively. Therefore, this publication can be said to disclose an ink-jet head and a driving method thereof, by which a stable print quality can be realized at low cost with respect to changes in viscosity of the ink, which varies depending on the ink type and/or the environment.

The present printer can be thought as an ink-jet printer that employs the driving method of piezoelectric elements of one embodiment of the present invention.

The ink-jet head of the present printer, for example, uses the driving circuit of FIG. 3, and has the ink pressure chambers with a multiplicity of nozzles, the driving circuit being provided for each of the ink pressure chambers. The ink-jet head of the present printer can be thought as an ink-jet head that ejects ink by causing the ink pressure chambers to expand and contract in response to a driving voltage applied to the piezoelectric elements that make up portions of the partition walls of the ink pressure chambers, or by causing the ink pressure chambers to directly contract without the expansion stroke.

The output voltage as shown in FIG. 3 may be selectively supplied to the piezoelectric elements B1 through Bn by the analog switches A1 through An according to image data. FIG. 5 can be described as a drawing of an oscillation model, explaining the ejecting system of the ink-jet head.

Another aspect of the present invention can be described as follows. What is notable in the circuit of FIG. 3 is that the slew rate $\alpha$ of the rise time Tr and fall time Tf of the output voltage Vo is set in the manner described below, for example, by adjusting resistance values of the resistors R3 and R4, so as to suppress a driving voltage, an amount of generated heat, and dissipated power. More specifically, the slew rate $\alpha$ is set to satisfy $\alpha \leqq 20 \times \Delta V/Ti$ (V/sec), where $\Delta V$ is the value of a voltage applied to the piezoelectric elements B1 through Bn, and Ti is the period of natural oscillation of the ink ejecting system of the ink-jet head. When the rise time and fall time of the pulse voltage are Tr and Tf, respectively, $\alpha = \Delta V/Tr$ (=Tf) and $1/20 \leqq Tr/Ti$, $Tf/Ti$. More preferably, $1/10 \leqq Tr/Ti$, $Tf/Ti$. This is because the displacement and the amount of generated heat (dissipated power) of the piezoelectric elements B1 through Bn vary as shown in FIG. 9, when the rise time Tr and fall time Tf are normalized with the period Ti of natural oscillation of the ink ejecting system to eliminate the influence of the shape of the ink-jet head and when these rise time Tr and fall time Tf are varied.

Note that, in FIG. 9, the oscillation energy of displacement is expressed by $Xp^2$, which is the square of a maximum displacement.

By thus setting the rise time Tr and fall time Tf of the pulse voltage to be not less than 1/20 of the period Ti of natural oscillation of the ink ejecting system of the ink-jet head, a desirable displaced amount can be obtained while suppressing a driving voltage, an amount of generated heat, and power dissipation.

Further, by setting the rise time Tr and fall time Tf of the pulse voltage to be not more than 1/3 of the period Ti of natural oscillation of the ink ejecting system, the displacement of the piezoelectric elements, which increases as the rise or fall of the voltage waveform becomes sharper, can reach or exceed the critical point (efficiency of 80%). Particularly, the ejection energy generated by the piezoelectric elements can be saturated almost completely in the vicinity of 1/20 of the period Ti of natural oscillation of the ink ejecting system.

Pertaining to the driving method wherein the ink pressure chambers are caused to expand and contract to eject ink, FIG. 10 shows displacement energy under the condition where the time required for the ink pressure chambers to expand and maintain the expansion is set to half the period Ti' of natural oscillation of the ink ejecting system and FIG. 11 shows its driving waveform. The piezoelectric elements attached to the ink pressure chambers expand with the driving waveform of phase A and contract with the driving waveform of phase B. That is, the piezoelectric elements receive a voltage Vh/2 in the state of non-driving, Vh when expanding, and 0 V when contracting, with respect to the voltage of contraction.

As FIG. 10 clearly indicates, by setting the rise time Tr and fall time Tf of the pulse voltage to be not less than 1/20 of the period Ti' of natural oscillation of the ink ejecting system, it is possible to obtain a desired amount of displacement while suppressing a driving voltage, an amount of generated heat, and dissipated power.

Further, by setting the rise time Tr and fall time Tf of the pulse voltage to be not more than 1/6 of the period Ti' of natural oscillation, the displacement of the piezoelectric elements, which increases as the rise or fall of the voltage waveform becomes sharper, can reach or exceed the critical point (efficiency of 80%). Particularly, the displacement of the piezoelectric elements can be saturated almost completely in the vicinity of 1/20 of the period Ti' of natural oscillation.

Further, maximum efficiency can be achieved by setting the sustained time Tv, which is the time period after the rise of the pulse waveform, to (Ti'−Tr)/2.

In another aspect of the present invention, there are provided first and second driving methods of piezoelectric elements, and first and second ink-jet recording apparatuses, as described below. The first driving method of piezoelectric elements sets the inequality $$1/20 \leqq Tr/Ti,\ Tf/Ti \leqq 1/3,$$

where Ti is the period of natural oscillation of the system that is oscillated by the piezoelectric elements, and Tr and Tf are the rise time and fall time, respectively, of the driving voltage applied to the piezoelectric elements.

According to this method, the rise time Tr and/or fall time Tf of the driving voltage are set to be not less than 1/20 of the period Ti of natural oscillation of the system that is oscillated by the piezoelectric elements. In this way, the method is able to suppress a driving voltage, an amount of generated heat, and dissipated power, which increase when there is a loss due to a resistor component of a charge/discharge system, such as wiring or switching elements, caused by a large current that is flown when the applied driving voltage to the piezoelectric elements, having an analogous structure to that of a capacitor with a dielectric placed between a pair of electrode, has a voltage waveform with a sharp rise and/or a sharp fall.

Further, by setting the rise time Tr and fall time Tf of the driving voltage to be not more than 1/3 of the period of natural oscillation, 80% or higher efficiency can be ensured for the oscillation energy of the piezoelectric elements, which increases as the rise or fall of the voltage waveform becomes sharper. Particularly, the displacement energy of the piezoelectric elements can be saturated almost completely in the vicinity of 1/20 of the period of natural oscillation.

The second driving method of piezoelectric elements, according to the first driving method of piezoelectric elements, sets $$Tv \approx (Ti-Tr)/2,$$

where Tv is the sustained time of the driving voltage.

A displacement of the piezoelectric elements with respect to the driving voltage becomes maximum at (Ti+Tr)/2. Therefore, a displacement of the piezoelectric elements can reach its maximum value when the driving voltage is sustained over the time period of sustained time Tv, which, according to the foregoing method, is the time period (Ti+Tr)/2 after the rise of the driving voltage.

Thus, maximum efficiency can be achieved by so setting the sustained time Tv of the driving voltage and, for example, by switching polarities of the driving voltage at the end of the sustained time Tv.

The first ink-jet recording apparatus includes an ink-jet head that has a multiplicity of ink pressure chambers with nozzles, the ink-jet head recording an image by ejecting the ink that is stored in the ink pressure chambers onto a sheet of paper by causing the piezoelectric elements, which make up portions of partition walls of the ink pressure chambers, to deform, wherein the first ink-jet recording apparatus achieves the foregoing by the first or second driving method of piezoelectric elements, using the period Ti of natural oscillation of the ink ejecting system of the ink-jet head.

With this configuration, high ejection efficiency can be obtained while suppressing a driving voltage, heat generation, and power dissipation.

The second ink-jet recording apparatus, according to the first ink-jet recording apparatus, is an ink-jet recording apparatus that is adapted to eject ink by causing the ink pressure chambers to expand and contract, and the second ink-jet recording apparatus sets the time required for the ink pressure chambers to expand and maintain the expansion to half the period Ti of natural oscillation of the ink ejecting system, or more preferably $1/20 \leqq Tr/Ti,\ Tf/Ti \leqq 1/6$.

With this configuration, by setting lower limits of the rise time Tr and fall time Tf of the driving voltage to be not less than 1/20 of the period Ti of natural oscillation of the ink ejecting system, it is possible to suppress a driving voltage, an amount of generated heat, and dissipated power, even when the time required for the ink pressure chambers to expand and maintain the expansion is half the period Ti of natural oscillation of the ink ejecting system. In particular, an amount of generated heat and dissipated power can be halved.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. A driving method of piezoelectric elements comprising the step of:

setting at least one of Tr and Tf to be not less than 1/20 of Ti, where Tr and Tf are a rise time and a fall time, respectively, of a driving voltage that is applied to the piezoelectric elements, and Ti is a period of natural oscillation of an oscillating system that is oscillated by the piezoelectric elements; and setting at least one of the Tr and Tf to be not more than 1/3 of the Ti.

2. The method as set forth in claim 1, wherein at least one of the Tr and Tf is set to be not less than 1/10 of the Ti.

3. The method as set forth in claim 1, wherein at least one of the Tr and the Tf is set to be not more than 1/6 of the Ti.

4. The method as set forth in claim 1, further comprising: setting a sustained time Tv of the driving voltage to satisfy $Tv \approx (Ti-Tr)/2$.

5. An ink-jet head, comprising:

a multiplicity of ink pressure chambers with partition walls, portion of the partition walls making up piezoelectric elements, said ink-jet head applying a driving voltage to the piezoelectric elements to cause the piezoelectric elements to deform, so as to eject ink that is stored in the ink pressure chambers, said ink-jet head setting at least one of Tr and Tf to be not less than 1/20 of Ti, where Tr and Tf are a rise time and a fall time, respectively, of the driving voltage that is applied to the piezoelectric elements, and Ti is a period of natural oscillation of an oscillating system in the ink pressure chambers, and said ink-jet head setting at least one of the Tr and Tf to be not more than 1/3 of the Ti.

6. The ink-jet head as set forth in claim 5, wherein at least one of the Tr and Tf is set to be not less than 1/10 of the Ti.

7. The ink-jet head as set forth in claim 5, wherein:

the ink is ejected by causing the ink pressure chambers to expand and contract, and at least one of the Tr and Tf is set to be not more than 1/6 of the Ti.

8. The ink-jet head as set forth in claim 5, wherein as sustained time Tv of the driving voltage is set to satisfy $Tv \approx (Ti-Tr)/2$.

9. An ink-jet printer, comprising:

an ink-jet head that includes a multiplicity of ink pressure chambers with partition walls, portions of the partition walls making up piezoelectric elements, said ink-jet head applying a driving voltage to the piezoelectric elements to cause the piezoelectric elements to deform, so as to eject ink that is stored in the ink pressure chambers, said ink-jet printer setting at least one of Tr and Tf to be not less than 1/20 of Ti, where Tr and Tf are a rise time and a fall time, respectively, of the driving voltage that is applied to the piezoelectric elements, and Ti is a period of natural oscillation of an oscillating system in the ink pressure chambers, and said ink-jet printer setting at least one of the Tr and Tf to be not more than 1/3 of the Ti.

10. A driving method of piezoelectric elements, comprising:

setting at least one of Tr and Tf to be not less than 1/20 of Ti, where Tr and Tf to be not less than 1/20 of Ti, where Tr and Tf are a rise time and a fall time, respectively, of a driving voltage that is applied to the piezoelectric elements, and Ti is a period of natural oscillation of an oscillating system that is oscillated by the piezoelectric elements; and setting a sustained time Tv of the driving voltage to satisfy $Tv \approx (Ti-Tr)/2$.

11. The method as set forth in claim 10, wherein at least one of the Tr and Tf is set to be not less than 1/10 of the Ti.

12. The method as set forth in claim 10, wherein at least one of the Tr and Tf is set to be not more than 1/6 of the Ti.

13. An ink-jet head, comprising:

a multiplicity of ink pressure chambers with partition walls, portion of the partition walls making up piezoelectric elements, said ink-jet head applying a driving voltage to the piezoelectric elements to cause the piezoelectric elements to deform, so as to eject ink that is stored in the ink pressure chambers, said ink-jet head setting at least one of Tr and Tf to be not less than 1/20 of Ti, where Tr and Tf are a rise time and a fall time, respectively, of the driving voltage that is applied to the piezoelectric elements, and Ti is a period of natural oscillation of an oscillating system in the ink pressure chambers, and said ink-jet head setting a sustained time Tv of the driving voltage to satisfy $Tv \approx (Ti-Tr)/2$.

14. The ink-jet head as set forth in claim 13, wherein at least one of the Tr and Tf is set to be not less than 1/10 of the Ti.

15. The ink-jet head as set forth in claim 13, wherein:

the ink is ejected by causing the ink pressure chambers to expand and contract, and at least one of the Tr and Tf is set to be not more than 1/6 of the Ti.

16. An ink-jet printer, comprising:

an ink-jet head that includes a multiplicity of ink pressure chambers with partition walls, portions of the partition walls making up piezoelectric elements, said ink-jet head applying a driving voltage to the piezoelectric elements to cause the piezoelectric elements to deform, so as to eject ink that is stored in the ink pressure chambers, said ink-jet printer setting at least one of Tr and Tf to be not less than 1/20 of Ti, where Tr and Tf are a rise time and a fall time, respectively, of the driving voltage that is applied to the piezoelectric elements, and Ti is a period of natural oscillation of an oscillating system in the ink pressure chambers, and said ink-jet printer setting a sustained time Tv of the driving voltage to satisfy $Tv \approx (Ti-Tr)/2$.

* * * * *